US005974984A

United States Patent [19]

Mitjans

[11] Patent Number: 5,974,984

[45] Date of Patent: Nov. 2, 1999

[54] ARTICLES OF FURNITURE

[75] Inventor: José Figueras Mitjans, LLica d'Amunt, Spain

[73] Assignee: Figueras International Seating, S.A., Barcelona, Spain

[21] Appl. No.: 09/075,937

[22] Filed: May 12, 1998

[30] Foreign Application Priority Data

May 27, 1997 [ES] Spain ..... 9701456

[51] Int. Cl.[6] ..... A47B 13/02

[52] U.S. Cl. ..... 108/150; 108/115

[58] Field of Search ..... 297/4; 108/115, 108/150, 142, 179, 10; 248/156, 188.2

[56] References Cited

U.S. PATENT DOCUMENTS

| | | | |
|---|---|---|---|
| 2,709,571 | 5/1955 | Mafera | 248/188.2 |
| 3,467,033 | 9/1969 | Seinkiewicz et al. | 108/150 |
| 4,098,478 | 7/1978 | Spitzke | 108/150 |

FOREIGN PATENT DOCUMENTS

| | | |
|---|---|---|
| 295589 | 6/1986 | Spain . |
| 295593 | 6/1986 | Spain . |
| 93 033 03 | 12/1993 | Spain . |

*Primary Examiner*—Peter M. Cuomo
*Assistant Examiner*—Gerald A. Anderson
*Attorney, Agent, or Firm*—Gary M. Nath; Harold L. Novick; Nath & Associates

[57] ABSTRACT

An article of furniture includes a table top (4) slidably and pivotally mounted on a column (2) the lower end of which is provided with a flange (3) fixing it to the floor of the conference hall. The table top (4) may be moved from a position (FIG. 2) in which it extends above and to one side of the column (2) to a position in which it lies parallel to the column (2) and adjacent the opposite side thereof. Levelling wedges (15) may be interposed between the flange (3) at the foot of the column (2) and a floor on which the column (2) is to be mounted to level the table top (4) when in its operative position.

10 Claims, 7 Drawing Sheets

ARTICLES OF FURNITURE

BACKGROUND OF THE INVENTION

1. Field of the Invention

The invention relates to articles of furniture.

2. Description of the Related Art

In halls in which conferences or similar activities are held it is necessary to have desk or tabletop associated with the seats provided for those attending, upon which those attending may place any necessary documents such as note books.

To achieve this it has been proposed to fit each seat with a table top which may be moved between a position in which it might be used for document support to a position in which it is at the side of the seat allowing an individual using the seat to exit therefrom.

This solution is inconvenient due to its limitations, and the weight resulting from the use of a seat.

Another proposed solution is to provide a table top movably mounted on the back of a seat which in use will be in front of the seat in which a person using the table top is seated. This has the disadvantage of badly positioning the table tops relative to the seats with which they are intended to use particularly if the seats of different rows are offset from one another and/or the rows are at different heights. Again, such an arrangement may cause discomfort or inconvenience to a person sitting in the seat on which the tabletop is mounted.

BRIEF SUMMARY OF THE INVENTION

An object of the invention is to provide an article of furniture which overcomes or at least alleviates these drawbacks and disadvantages.

In a first aspect the invention provides an article of furniture which comprises a supporting column a first end of which is provided with a flange for fixing the column to a floor and a second end of which supports a table top carried on the column by an articulated assembly enabling the table top to be moved from a first position extending, in use, above and to one side of the column and a second position in which the tabletop lies substantially parallel to the column and adjacent the side of the column opposite said one side.

The column may have longitudinal grooves formed therein in which are located guide means having fixed parts attached to the material of the column and moving parts carried on the fixed part and operable to slide therealong.

Ball bearings may be provided between the fixed parts and the moving parts of the guide means.

The table top is preferably carried on a hinge member pivotally mounted on the moving parts of the guide means.

Movement of the moving parts of the guide means toward the second end of the column may be limited by a covering element closing said second end of the column and enabling the maintenance in use, of the table top in said first position.

Movement of the moving parts of the guide means may be limited by the length of the fixed parts and by the fact that the moving parts are formed with projections operable to support the table top in said second position The hinge member may be formed with a channel in the face thereof which is adjacent, in use, said column and a small projection may be formed on the column, the channel and projection cooperating to guide movement of the table top between said first and second positions.

The article of furniture may further include wedges for placement between said flange and a floor upon which the column is to be mounted, said wedges being operable to level said table top when in said second position.

In both positions of the table top the moving parts of the guide means serve as stops to maintain the position of the table top. Again the moving parts of the guide means overlie or cover the corresponding fixed parts of the guide means preserving the aesthetic appearance of the article of furniture and protecting users from any lubricant (e.g. oil) for the guide means.

The arrangement proposed is easy to install in a desired position in front of an associated seat affording the user the maximum of comfort.

As the article of furniture is wholly independent of the seat with which it is to be used it cannot interfere with the use of the seat thus avoiding any inconvenience for a user. Again the table top is wholly independent of any seat in front of the seat with which it is to be used avoiding any consequence disturbance, from knocks, leaning or the like which could affect an occupant in the seat in front.

The folding nature of the arrangement allows withdrawal freeing the space between the rows of seats and in this way the free passage between the rows of seats is preserved.

Again, the article of furniture provides no impediment to cleaning or maintenance work.

BRIEF DESCRIPTION OF THE SEVERAL VIEWS OF THE DRAWINGS

The above aspects, features and advantages of the present invention will become apparent from the following description of embodiments thereof now made with reference to the accompanying drawings in which.

DETAILED DESCRIPTION OF THE PREFERRED EMBODIMENTS OF THE INVENTION

Figure 1:
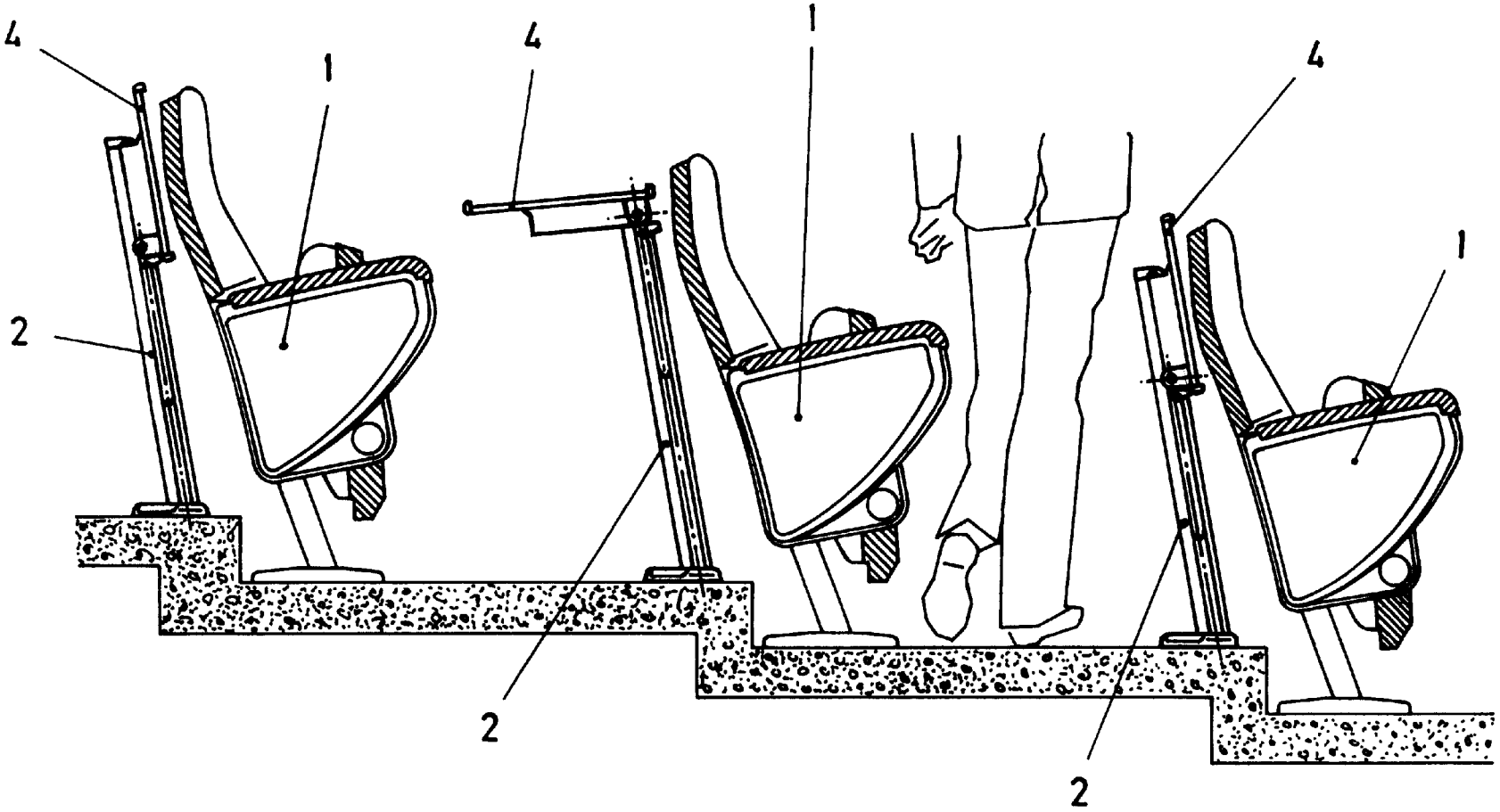
FIG. 1 is a side view showing the distribution of seats in a staggard arrangement of different heights incorporating articles of furniture embodying the invention.

With reference now to the drawings. Articles of furniture embodying the invention are intended to be positioned relative to seats (1) in a conference hall or similar, which seats are generally arranged in staggard rows at different heights and offset from one another in the different rows—as can be seen from FIG. 1.

Each article of furniture comprises a supporting column (2) a first, lower, end of which is fitted with a flange (3) for fixing it to the floor of the conference hall, its second, upper, in use, end carries a table top supported on column (2) by an articulated assembly.

Figure 2:
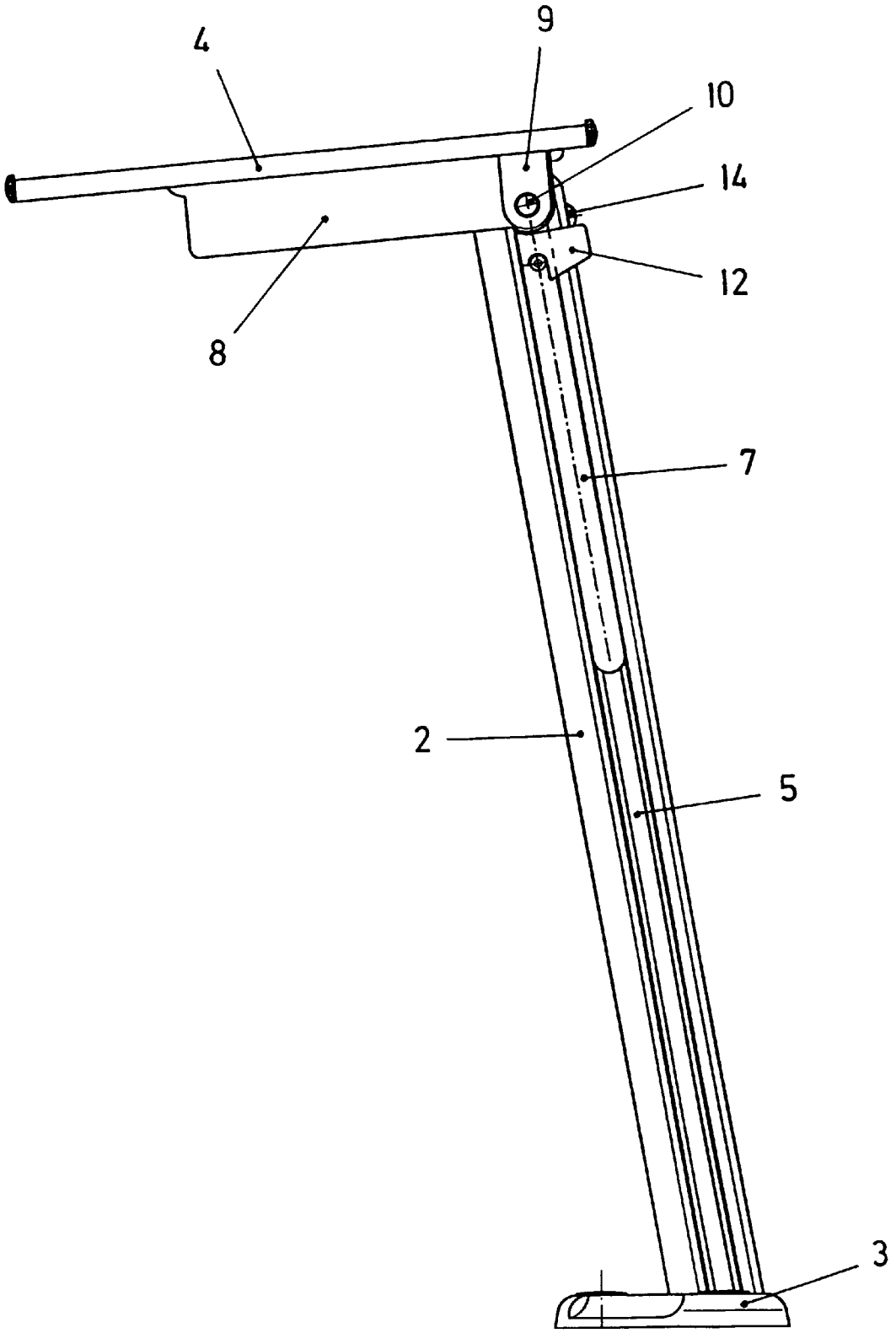
FIGS. 2 and 3 are side views of the article of furniture in unfolded and folded positions respectively.
Figure 3:
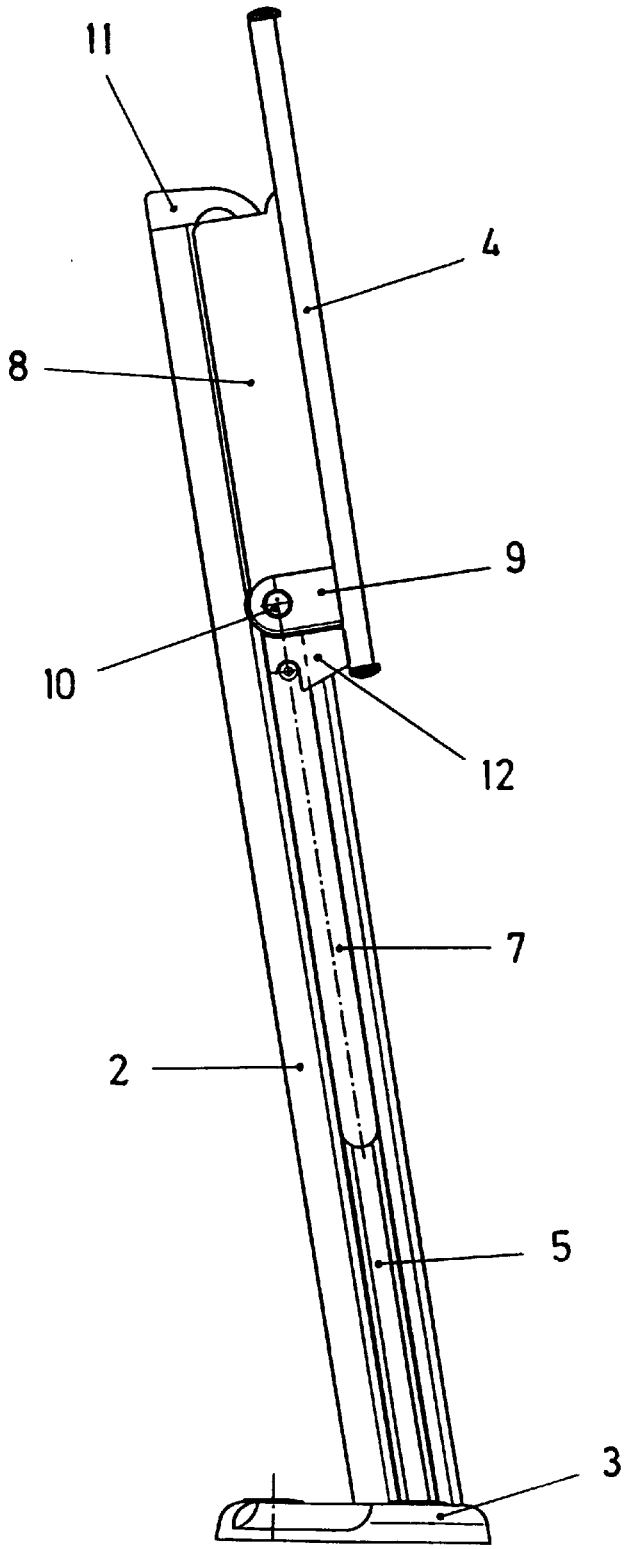
Figure 4:
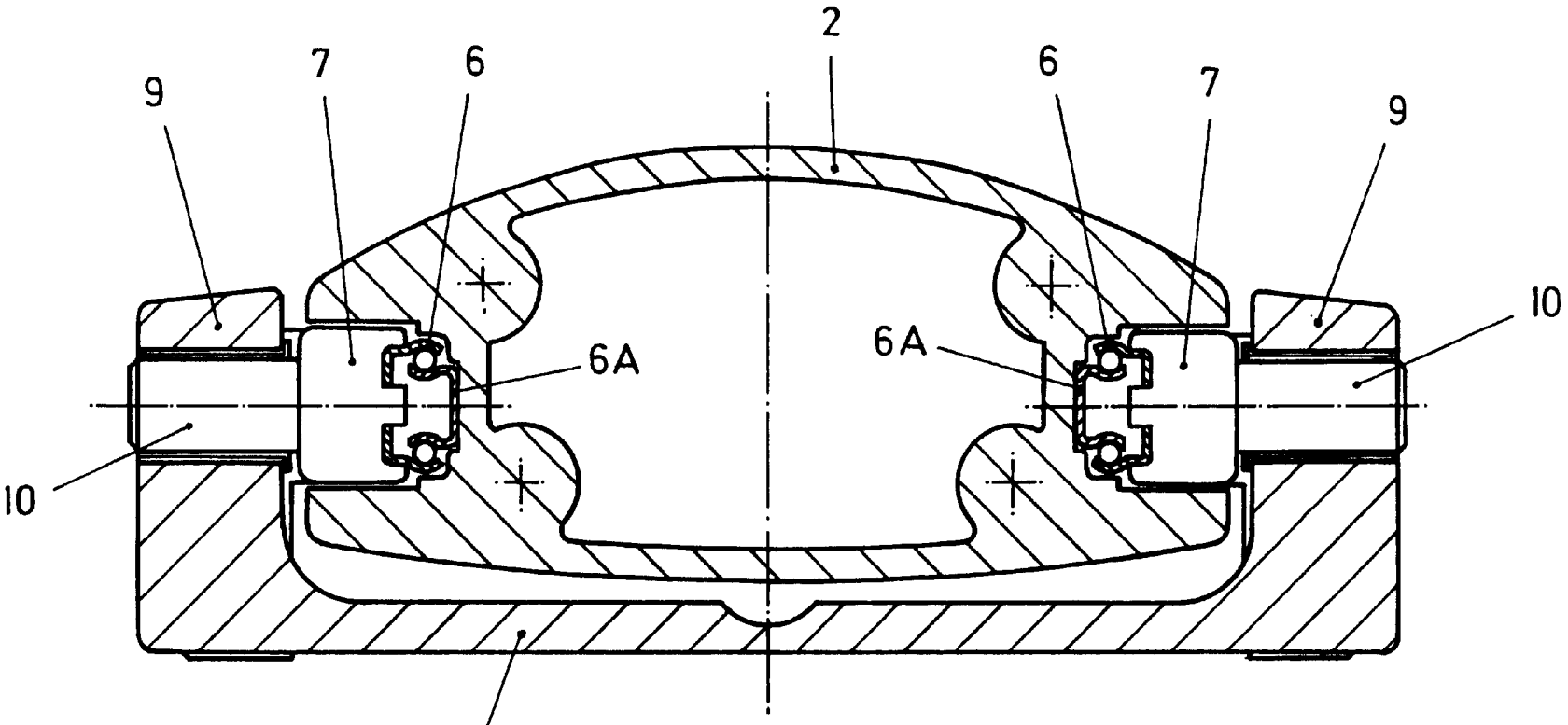
FIG. 4 is an enlarged plan cross-sectional view of the column of the article of furniture with the hinge member.
Figure 7:
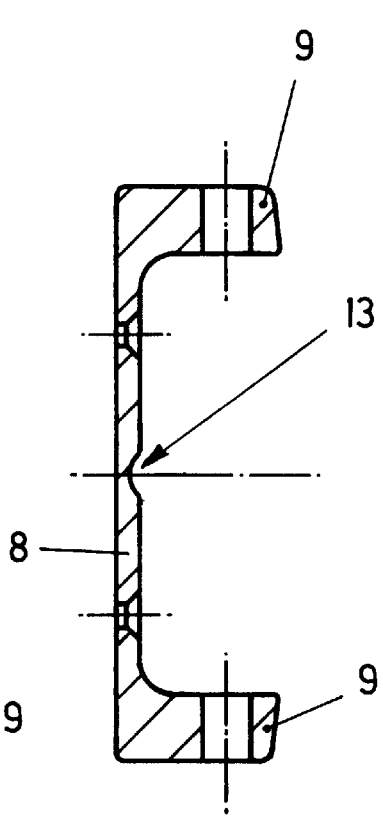
FIGS. 5, 6 and 7 are respectively an underneath plan view, an end view and a transverse sectional view of the hinge member included in the article of furniture.
Figure 6:
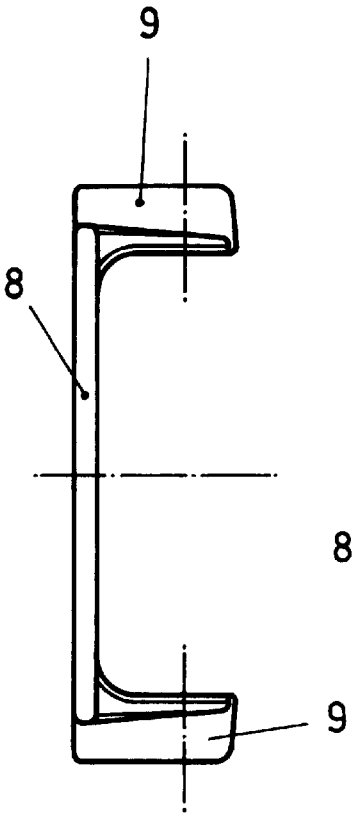
Figure 5:
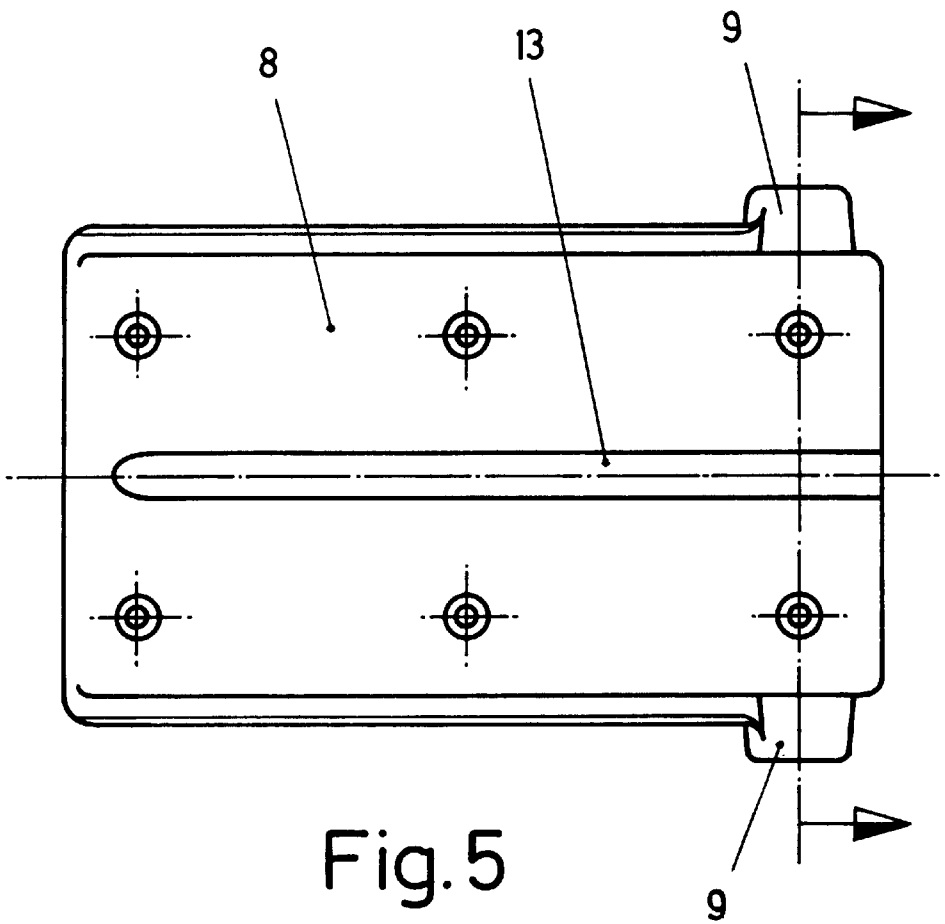
Figure 9:
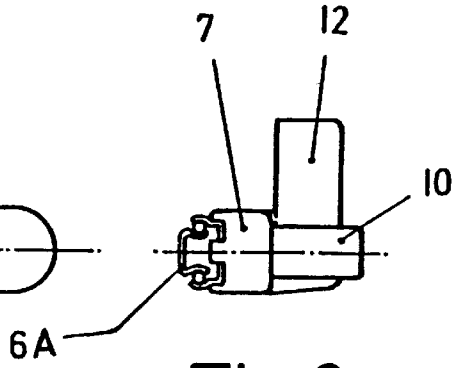
FIGS. 8, 9 and 10 are respectively a front view, an end view and a side view of the moving part of the guide means incorporating the article of furniture.
Figure 8:
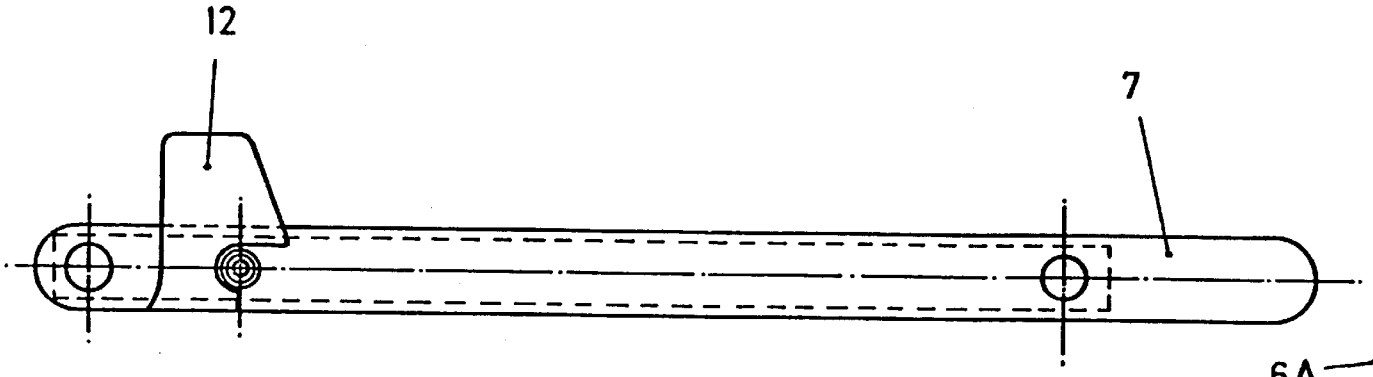
Figure 10:
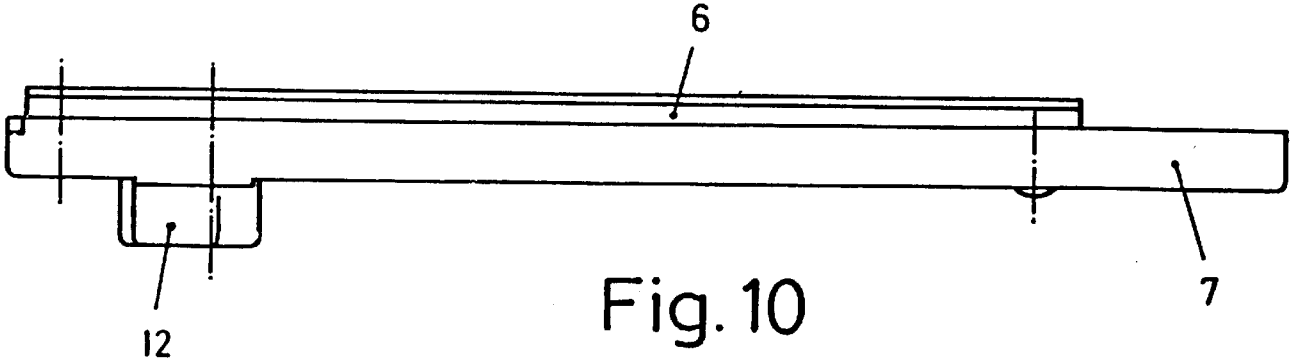

As can be seen more clearly from FIGS. 2 and 3 supporting column (2) is provided with longitudinal grooves (5) in which are fitted guide means. Each guide means comprises a fixed part (6A), which is fixed to the material of column (2) and a part (7) carried on the fixed part (6A) and operable to slide therealong. The parts (7) are thereby able to slide along grooves (5) within the range allowed by the guide part (6A). Ball bearings (6) are provided to ease movement of the moving part (7) relative to the fixed part (6A) of the guide means.

At the upper ends of the moving parts (7) the table top (4) is hingably supported thereon. The table top (4) is hingably supported on the moving parts (7) of the guide means by a hinge piece (8) which has a depending pair of legs (9) which are supported, in a rotatable manner, on respective spindles (10) attached to the moving parts (7) of the guide means. The hinge member (8) mas the form of a plate to which the table top (4) is screwed.

It will be appreciated from the forgoing that due to this configuration the table top (4) can move in a sliding and pivoting manner from the position shown for example in FIG. 2 in which it extends above and to one side of the column (2) to the position shown in FIG. 3 in which it extends generally parallel to and adjacent the opposite side of the column (2).

When in the position shown in FIG. 2 table top is stably maintained in that position by the interaction of the upper ends of the moving parts (7) abutting a top closurre (11) for column (2).

When in the position shown in FIG. 3, with the table top (4) lying parallel to and adjacent column (2) it is maintained in the position shown by the moving parts (70 being unable to move further relative to the fixed parts (6A) of the guide means and the moving parts (7) being provided with protuberances or lugs (12) which serve to support the tabletop (4) in the position shown in the Figure.

The hinge member (8) is further provided with a channel (13) in the face thereof which in use faces column (2) which cooperates with a small projection (14) formed on the column by way of a guide when the table top is being moved between the positions shown in FIG. 2 and FIG. 3.

As a result of this the article of furniture in question may be arranged individually by fixing to the floor in front of a seat (1) with which it is to be used independently of that seat or any other seat in the conference hall.

In this way the use of the respective seat is enabled by positioning the table top (4) as shown in FIG. 2 whilst the lowering of the table top to the position shown in FIG. 3 allows the easy passage between the rows of seats (1).

It will be appreciated that the movement between the position shown in FIG. 3 and FIG. 2 is very easy to achieve and it is only necessary to pull the table top (4) upwardly and then towards the user to bring it to the position in FIG. 2. In moving it from the position shown in FIG. 2 to the position shown in FIG. 3 again it is only necessary for the user to tilt the table top 4 and allow it to fall down the column (2).

It will be appreciated further that the moving parts (7) of the guide means cover the fixed part (6A) creating a pleasing aesthetic appearance and at the same time protecting a user from stains from any lubricant used for the guide means.

Figure 13:
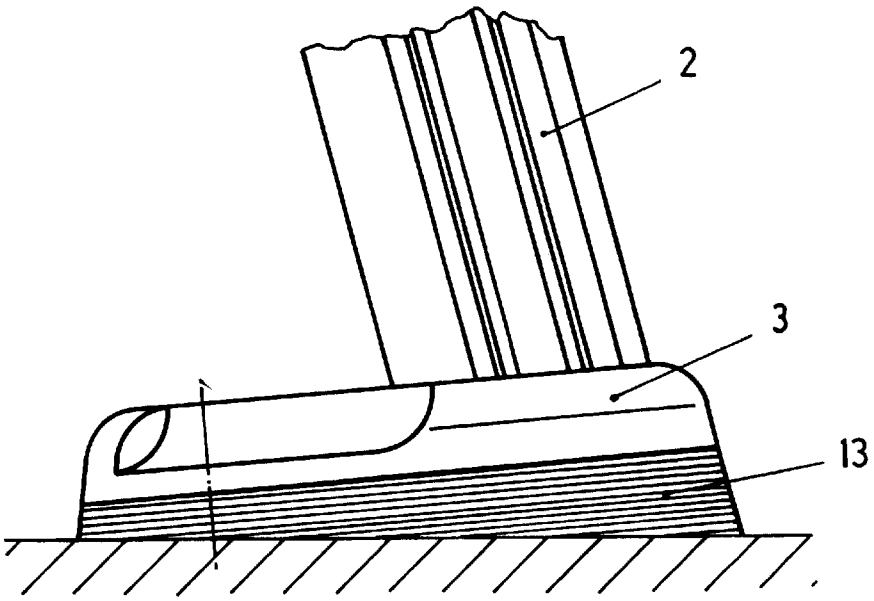
FIG. 13 is a detailed side view of a lower part of the column and a levelling wedge.
Figure 11:
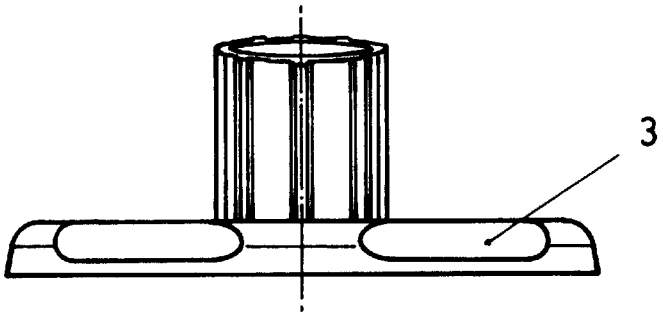
FIGS. 11 and 12 are respectively front elevation and plan views of the flange.
Figure 12:
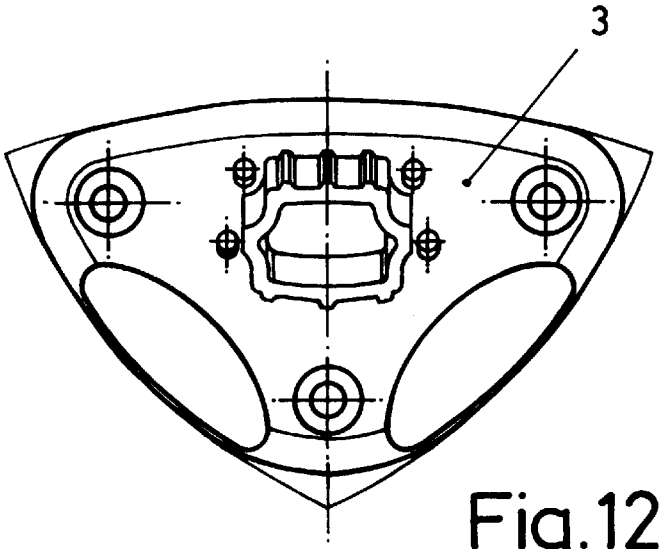

If the floor of a conference hall should be sloping provision is made with the arrangement of the invention by the provision of matching wedges (15) with contours conforming to those of the flanges (3) placed under the flanges (3) as can be seen in FIG. 13.

Different wedges (15) may be provided with difference angles of inclination for use depending upon the gradient of the floor on which the articles of furniture are to be mounted.

I claim:

1. An article of furniture comprising:

a supporting column having a first end, a second end, a first side and a second side opposite said first side, said column having longitudinal grooves formed therein;

a flange for fixing said first end of said column to a floor;

a table top rested on said second end of said column;

an articulated assembly that mounts said table top to said column, said assembly enabling said table top to be moved between a first position for use in which said table top extends above and to said first side of said column and a second position in which said table top lies substantially parallel to said column and adjacent said second side; and said articulated assembly includes a guide means having fixed parts attached to said column within said grooves and having moving parts carried on the fixed parts for easy sliding movement.

2. An article of furniture as claimed in claim 1, wherein movement of the moving parts of said guide means is within the range allowed by the fixed parts thereof and said moving parts of said guide means are formed with protuberances operable to support said table top in said second position.

3. An article of furniture as claimed in claim 1, comprising:

ball bearings provided between said fixed parts and said moving parts of said guide means.

4. An article of furniture as claimed in claim 3, wherein movement of said table top towards said second end of said column is limited by a cover closing said second end of said column and enabling maintenance, in use, of said table top in said first position.

5. An article of furniture as claimed in claim 3, further including a wedge for placement between said flange and a floor upon which said column is to be mounted, said wedge being operable to level said table top when in said first position.

6. An article of furniture as claimed in claim 1, wherein the table top is carried on a hinge member pivotally mounted on the moving parts of the guide means.

7. An article of furniture as claimed in claim 6, wherein movement of the moving parts of said guide means is within the range allowed by said fixed parts thereof and in that said moving parts of said guide means are formed with protuberances operable to support said table top in said second position.

8. An article of furniture as claimed in claim 7, wherein the hinge member is formed with a channel in a face thereof adjacent said column, and wherein a projection is formed on said column, channel and projection cooperating to guide movement of said table top between said first and said second positions.

9. An article of furniture as claimed in claim 6, wherein movement of said moving parts of said guide means towards said second end of said column is limited by a cover closing said second end of said column and enabling maintenance, in use, of said table top in said first position.

10. An article of furniture as claimed in claim 9, wherein the hinge member is formed with a channel in a face of said hinge member adjacent said column to cooperate with a projection which is formed on the column.

* * * * *